US006440223B1

(12) United States Patent
Dube et al.

(10) Patent No.: US 6,440,223 B1
(45) Date of Patent: Aug. 27, 2002

(54) SMOKING ARTICLE CONTAINING HEAT ACTIVATABLE FLAVORANT-GENERATING MATERIAL

(75) Inventors: Michael Francis Dube; William Monroe Coleman, III; Luis Mayan Dominguez; Kenneth Wayne Smith, all of Winston-Salem, NC (US)

(73) Assignee: R. J. Reynolds Tobacco Co., Winston-Salem, NC (US)

( * ) Notice: Subject to any disclaimer, the term of this patent is extended or adjusted under 35 U.S.C. 154(b) by 0 days.

(21) Appl. No.: 09/504,173

(22) Filed: Feb. 15, 2000

(51) Int. Cl.[7] ..... A24B 15/30

(52) U.S. Cl. ..... 131/276; 131/276; 131/275; 131/278; 131/369; 131/359; 131/352; 162/139

(58) Field of Search ..... 131/276, 274, 131/275, 278, 369, 359, 352; 162/139

(56) References Cited

U.S. PATENT DOCUMENTS

| | | | | |
|---|---|---|---|---|
| 3,316,919 | A | | 5/1967 | Green et al. |
| 3,424,171 | A | | 1/1969 | Rooker |
| 3,478,015 | A | | 11/1969 | Onishi et al. |
| 3,722,516 | A | | 3/1973 | Suwa et al. |
| 3,760,815 | A | | 9/1973 | Deszyck |
| 3,828,798 | A | | 8/1974 | Harper et al. |
| 3,920,026 | A | | 11/1975 | Warfield et al. |
| 3,929,141 | A | | 12/1975 | Beringer et al. |
| 3,934,594 | A | | 1/1976 | Beringer et al. |
| 4,040,431 | A | | 8/1977 | Ashworth et al. |
| 4,079,742 | A | | 3/1978 | Rainer et al. |
| 4,150,677 | A | | 4/1979 | Osborne, Jr. et al. |
| 4,184,495 | A | | 1/1980 | Rainer et al. |
| 4,286,606 | A | | 9/1981 | Swain et al. |
| 4,306,577 | A | | 12/1981 | Wu et al. |
| 4,379,464 | A | * | 4/1983 | Wu et al. ..... 131/275 |
| 4,407,307 | A | | 10/1983 | Gaisch et al. |
| 4,421,126 | A | | 12/1983 | Gellatly |
| 4,481,956 | A | | 11/1984 | Chan |
| 4,506,682 | A | | 3/1985 | Muller |
| 4,506,684 | A | * | 3/1985 | Keritsis ..... 131/369 |
| 4,516,590 | A | | 5/1985 | Teng |
| 4,537,204 | A | | 8/1985 | Gaisch et al. |
| 4,538,627 | A | | 9/1985 | Chan et al. |
| 4,566,468 | A | | 1/1986 | Sachleben et al. |
| RE32,095 | E | | 3/1986 | Wu et al. |
| 4,596,259 | A | | 6/1986 | White et al. |
| 4,605,016 | A | | 8/1986 | Soga et al. |
| 4,607,646 | A | | 8/1986 | Lilly, Jr. et al. |
| 4,628,947 | A | | 12/1986 | Driscoll et al. |
| 4,638,816 | A | | 1/1987 | Cox et al. |
| 4,674,519 | A | | 6/1987 | Keritsis et al. |
| 4,677,994 | A | | 7/1987 | Denier et al. |
| 4,701,282 | A | | 10/1987 | Chan et al. |
| 4,715,388 | A | | 12/1987 | Rainer |
| 4,744,375 | A | | 5/1988 | Denier et al. |
| 4,760,854 | A | | 8/1988 | Jewell et al. |
| 4,827,949 | A | | 5/1989 | Sunas |
| 4,941,484 | A | | 7/1990 | Clapp et al. |
| 4,986,286 | A | | 1/1991 | Roberts et al. |

(List continued on next page.)

FOREIGN PATENT DOCUMENTS

| | | |
|---|---|---|
| DE | 1 517 280 | 9/1969 |
| EP | 0 110 693 A1 | 6/1984 |
| EP | 0 517 407 A2 | 12/1992 |
| EP | 0 821 886 A2 | 2/1998 |
| FR | 2 767 649 A1 | 3/1999 |
| GB | 572236 | 9/1945 |
| GB | 1383029 | 2/1975 |
| GB | 2 239 654 A | 7/1991 |
| JP | 57-71388 | 5/1982 |
| JP | 61-15675 A2 | 1/1986 |
| WO | WO 97/04673 A1 | 2/1997 |

OTHER PUBLICATIONS

Factors Affecting the Formation of Pyrazine Compounds in Sugar–Amine Reactions, P. E. Koehler et al., J. Agr. Food Chem., vol. 18, No. 5, 1970, pp. 895–898.

Formation of Pyrazine Compounds in Sugar–Amino Acid Model Systems, P. E. Koehler et al., J. Agr. Food Chem., vol. 17, No. 2, Mar.–Apr. 1969, pp. 393–396.

Mutarotation, Hydrolysis, and Rearrangement Reactions of Glycosylamines, H. S. Isbell et al., The Journal of Organic Chemistry, vol. 23, No. 8, 1958, pp. 1309–1319.

Parameter Effects on the Thermal Reaction of Cystine and 2,5–Dimethyl–4–hydroxy–3(2H)–Furanon, C. Shu et al., Chap. 21, Thermal Generation of Aromas, 1989 American Chemical Society, pp. 229–241.

Pyrazine Formation From Serine and Threonine, C. Shu, J. Agric. Food Chem., vol. 4A, No. 10, 1999, pp. 4332–4335.

Studies on the Aroma of Roasted Coffee, W. Grosch et al., Thermally Generated Flavour, Flavour Science: Recent Developments, pp. 200–205.

The Design of Cigarettes, C. L. Browne, 1979, pp. 17–24, 56.

The Reaction of Gluocose with Some Amines, E. Mitts et al., Journal of the American Chemical Society, vol. 66, No. 2, 1944, pp. 483–487.

The Variety of Odors Produced in Maillard Model Systems and How They Are Influenced by Reaction Conditions, M. J. Lane et al., Maillard Reactions, 1983 American Chemical Society, pp. 141–158.

*Primary Examiner*—Christopher A. Fiorilla
*Assistant Examiner*—Mark Halpern

(57) ABSTRACT

This invention provides a method for improving the flavor and aroma properties in a smoking article. A high fructose corn syrup, ammonium hydroxide and diammonium phosphate are reacted with each other for a time and under conditions sufficient to provide a heat activatable flavorant-generating composition, which comprises 2-deoxy 2-amino glucose. The composition is incorporated into a component of said smoking article without heat treatment. The resultant smoking articles, when smoked, exhibit highly desirable flavor and aroma properties.

18 Claims, No Drawings

U.S. PATENT DOCUMENTS

| | | | | |
|---|---|---|---|---|
| 5,016,654 | A | | 5/1991 | Bernasek et al. |
| 5,018,540 | A | | 5/1991 | Grubbs et al. |
| 5,038,802 | A | | 8/1991 | White et al. |
| 5,060,663 | A | | 10/1991 | Rainer |
| 5,060,669 | A | | 10/1991 | White et al. |
| 5,065,775 | A | | 11/1991 | Fagg |
| 5,074,319 | A | | 12/1991 | White et al. |
| 5,099,862 | A | | 3/1992 | White et al. |
| 5,121,757 | A | | 6/1992 | White et al. |
| 5,131,415 | A | | 7/1992 | Munoz et al. |
| 5,159,942 | A | | 11/1992 | Brinkley et al. |
| 5,234,008 | A | | 8/1993 | Fagg |
| 5,235,992 | A | | 8/1993 | Sensabaugh, Jr. |
| 5,284,166 | A | | 2/1994 | Cartwright et al. |
| 5,318,050 | A | | 6/1994 | Gonzalez-Parra et al. |
| 5,339,838 | A | | 8/1994 | Young et al. |
| 5,370,139 | A | * | 12/1994 | Shu et al. ..... 131/274 |
| 5,413,122 | A | | 5/1995 | Shu et al. |
| 5,598,868 | A | | 2/1997 | Jakob et al. |
| 6,048,404 | A | | 4/2000 | White |

* cited by examiner

SMOKING ARTICLE CONTAINING HEAT ACTIVATABLE FLAVORANT-GENERATING MATERIAL

FIELD OF THE INVENTION

The present invention generally relates to smoking articles such as cigarettes, and in particular to smoking articles containing heat activatable flavorant-generating composition and process for making same.

BACKGROUND OF THE INVENTION

Flavor and aroma are important characteristics of smoking articles. To improve the flavor and aroma in smoking articles, flavorful and aromatic substances, including various natural extracts, have been included in smoking articles. For example, various processes for producing and using tobacco extracts, aroma oils and concentrates are proposed in the U.S. Pat. No. 3,136,321 to Davis; U.S. Pat. No. 3,316,919 to Green; U.S. Pat. No. 3,424,171 to Rooker; U.S. Pat. No. 4,421,126 to Gellatly and U.S. Pat. No. 4,506,682 to Mueller and European Patent Publication No. 338,831 to Clapp et al.

U.S. Pat. No. 5,413,122 discloses making a flavorful and aromatic composition from β-hydroxy α-amino acids by contacting the amino acids with a liquid having an aqueous character. The ratio of liquid to amino acid is 4:1 to 40:1. The mixture is subjected to heat treatment in an enclosed environment to react the amino acids and to thereby provide an aqueous solution of volatile pyrazine flavorants. The resulting aqueous extract containing flavorful pyrazines is then applied to smoking materials to provide flavor and aroma in the smoking articles.

It has also been proposed to react sugars with amino acids to produce desirable flavorants for smoking articles and foods. For example, U.S. Pat. No. 3,478,015 discloses heating a mixture of an amino acid and a sugar in the presence of a polyhydric alcohol and using the reaction product as a flavoring material.

U.S. Pat. No. 3,920,026 describes reacting the amino acid valine with a sugar, other hydroxycarbonyl compound, or dicarbonyl compound under heat treatment in a solvent such as glycerol or propylene glycol and at a temperature of about 100° C. to about 200° C. for about 0.5 to 5 hours. Optionally, a catalyst such as a flavanoid or hydroxyacid is included in the reaction. The reaction products can be used as flavorants in tobacco compositions.

U.S. Pat. No. 4,306,577 discloses the production of flavorants for smoking compositions by reacting reducing sugars and selected amino acids in the presence of ammonium hydroxide and optionally in the presence of an aldehyde in an essentially solvent-free system at a temperature range of 90° C. to 115° C. The selected amino acids are those that have at least two nitrogens such as glutamine, asparagine, lysine, and arginine.

Similarly, U.S. Pat. No. Re. 32,095 discloses reacting a reducing sugar with a source of ammonia in the presence of a trace amount of certain amino acids at a temperature in the range of about 90° C. to about 115° C. for about 5 to 15 minutes. The trace amino acids include aspartic acid, glutamic acid, asparagine, and glutamnine. The weight ratio of sugar to amino acid is in the range of 200–300:1, and the weight ratio of sugar to ammonia source is about 5–15:1.

U.S. Pat. No. 4,286,606 proposes reacting carboxylic acids having a carbon chain of 6 to 26 carbon atoms with a reducing sugar in the presence of ammonia or ammonium hydroxide under heated conditions to produce flavorants for use in smoking articles.

U.S. Pat. No. 4,638,816 describes another method for improving the flavor and aroma characteristics in cigarettes. Glucose is reacted with ammonium hydroxide to produce so called 1-deoxy 1-amino sugars such as 1-deoxy 1-aminoglucose, which are stable and odorless at ambient temperatures. The 1-amino sugar is applied to tobacco fillers. The 1-deoxy 1-amino sugar-impregnated fillers are then subjected to a heat treatment at a high temperature. The heat treatment is said to convert the 1-amino sugar to a "browning" complex such as pyrazine-containing compounds. The cigarettes made thereof are said to have enhanced flavor when smoked.

Although these and other materials can enhance the taste of tobacco products, because of the volatile nature of flavorant and aroma materials, they are often lost at least in part during cigarette manufacturing and packaging steps. Also quantities of the flavorant and aroma materials can diminish during the storage of the finished smoking articles and it is often necessary to increase the initial content of flavorants to compensate.

SUMMARY OF THE INVENTION

In accordance with the present invention, a heat activatable flavorant-generating composition comprising 2-deoxy 2-amino sugars is generated by reacting a mixture consisting essentially of a fructose source, ammonium hydroxide, and optionally diammonium phosphate. The heat activatable flavorant-generating composition is significantly less volatile than conventional flavorful and aromatic substances, and is converted to flavorants such as pyrazine under smoking conditions, i.e., during smoking. The composition can be used as top dressing and incorporated directly into smoking articles without any heating prior to smoking. The resultant smoking articles, when smoked, exhibit highly desirable flavor and aroma properties.

Accordingly, in a first aspect, the present invention relates to a method for improving the flavor and aroma properties in a smoking article. An aqueous mixture of reactable components consisting essentially of a fructose source, ammonium hydroxide, and optionally diammonium phosphate is reacted for a time and under conditions sufficient to provide a heat activatable flavorant-generating composition. In particular, the mixture is exposed to a temperature sufficiently high and for a period of time sufficiently long so as to provide a heat activatable flavorant-generating composition, which comprises one or more 2-deoxy-2-amino sugar compounds. However, because the composition is heat activatable, it is preferable that the reaction mixture is not exposed to such a high temperature for a sufficiently long period of time so as to degrade the amino sugars or to convert them into volatile flavorants. Typically the components of the mixture are allowed to react with each other at a temperature of no greater than about 85° C., preferably no greater than about 50° C. Conveniently, the reaction can be carried out at about room temperature, i.e., about 25° C.

The resultant composition, which contains 2-deoxy 2-amino sugars, can be stored under ambient or refrigerated conditions for substantial time periods of at least about 60 days up to about 4 months without any significant conversion of the materials to volatile flavorants or degradation of the active materials. Moreover, once applied to tobacco materials, the compositions are stabilized by components of the tobacco and can be stored under normal conditions without degradation.

The heat activatable flavorant-generating composition can be directly incorporated into smoking articles without further heat treatment and without heating the tobacco. For example, the composition can be applied as top dressing components for tobacco cut fillers, as well as for other smokable materials. Alternatively, such heat activatable flavorant-generating composition can be incorporated into other types of smoking articles described in, e.g., U.S. Pat. No. 4,708,151 to Shelar; U.S. Pat. No. 4,714,082 to Banerjee et al.; U.S. Pat. No. 4,756,318 to Clearman et al.; and U.S. Pat. No. 4,793,365 to Sensabaugh et al.; as well as European Patent Publication Nos. 212,234 and 277,519.

The heat activatable flavorant-generating composition of this invention typically contains about 0.01 to about 15% by weight of 2-deoxy 2-amino glucose and also has relatively low volatility in both solutions and smoking articles. When the composition is incorporated into a smoking article, flavorful and aromatic substances are generated when the smoking article is smoked. Consequently, the loss of flavorants and aroma substances during the manufacturing process and storage of smoking articles is reduced. Further, the smoking articles can have more consistent and uniform flavorful and aromatic characters because the flavor compositions are not lost as a function of time. As a result, smoking articles with improved flavor and aroma can be made with the heat activatable flavorant-generating composition.

In addition, in the method of this invention, fructose, ammonium hydroxide, and optionally diammonium phosphate are the only components required. The heat activatable flavorant-generating composition is produced at a high yield while no additional costly reagents such as amino acids or carboxylic acids are needed. Further, no preheating treatment of the flavorant-generating composition or of tobacco treated with the composition is required. Indeed, preheating is undesirable. Moreover, because loss of the flavorant-generating composition during manufacturing and storage of the smoking articles is minimal, lower quantities of the composition can be used as compared to the direct addition of volatile flavorants. As a result, the cost associated with the method of this invention is low.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

DETAILED DESCRIPTION OF THE INVENTION

This invention provides a smoking article containing a heat activatable flavorant-generating composition. The flavorant-generating composition is produced by the reaction in an aqueous mixture of a fructose source, ammonium hydroxide, and optionally diammonium phosphate.

Any conventional fructose sources can be used. It can be purified fructose, or a crude form of fructose. For example, fructose-containing corn syrup can be conveniently used in the present invention. Preferably, a high fructose corn syrup (HFCS) having at least about 30% by weight of fructose is used. For example, a high fructose corn syrup having about 42% by weight of fructose is commercially available from Corn Products International, Bedford Park, Ill. Disaccharides or polysaccharides that can hydrolyze and generate fructose under the reaction conditions employed in the method of this invention can also be included in or constitute the fructose source.

In addition to fructose, the fructose source can also contain other reducing sugars such as glucose, mannose, galactose, rhamnose, and the like. Sugars will not substantially affect the desired results of the invention. Like fructose, such other reducing sugars may also react with ammonium hydroxide and/or diammonium phosphate to form amino sugars. However, it has been discovered that fructose is more reactive with ammonium sources to form 2-deoxy 2-amino sugars with a high yield. In addition, when the mixture contains a large amount of fructose, the heat activatable flavorant-generating composition produced from the method of this invention easily releases flavorful and aromatic substances under smoking conditions, and it is unnecessary to preheat tobacco fillers impregnated with such flavorant-generating materials in smoking article manufacturing. However, other reducing sugars, whether added concurrently with, or separately from, the fructose are considered part of the fructose source.

In particular, as used herein, the term "fructose source" means a composition containing fructose in which the ratio of the total weight of fructose including free fructose and fructose to be generated from disaccharide and polysaccharide under the reaction conditions of this invention, to the total weight of other reducing sugars is at least about 1:10, preferably at least about 1:4, more preferably at least about 1:2, and advantageously greater than about 1:1.

Ammonium hydroxide can be added to the aqueous mixture in the form of ammonia gas, or as ammonium hydroxide, e.g., aqueous ammonium hydroxide solution. Ammonium salts that form ammonium hydroxide in aqueous media can also be used in lieu of or in addition to ammonium hydroxide. Such ammonium salts include ammonium orthophosphate, ammonium dihydrogen orthophosphate, diammonium monohydrogen orthophosphate, ammonium citrate, ammonium acetate, ammonium carbonate and the like. In a preferred embodiment, the aqueous mixture contains a fructose source, ammonium hydroxide, and diammonium phosphate. It has been found that diammonium phosphate although not contributing substantially to the yield of 2-deoxy 2-amino sugars, can improve certain other desirable characteristics of the resultant heat-activatable flavorant-generating composition, especially when the heat treatment is at a high temperature.

Preferably, the aqueous mixture does not contain any significant amount of components that are capable of reacting with the sugars (fructose and other reducing sugars) or ammonium hydroxide or diammonium phosphate to introduce moieties other than amino groups in the sugars. In other words, the aqueous mixture typically does not contain any significant amount of chemicals that will substantially interfere or compete with the reactions between the sugars and the ammonium hydroxide and/or diammonium phosphate for forming heat activatable flavorant-generating composition. Examples of such undesirable components are, e.g., carboxylic acid such as fatty acids, amino acids, etc. Generally, the content of such undesirable materials should be less than about 1% by weight, preferably less than 0.3% by weight, more preferably less than 0.010% by weight based on the reducing sugar content.

In the aqueous mixture, the content of fructose can be from about 5% to about 90%, preferably from about 10% to about 80%, more preferably from about 20% to about 50% by weight based on the total weight of the mixture. The content of ammonium hydroxide can be from about 0.5% to about 40%, preferably from about 1% to about 30% by weight based on the total weight of the mixture.

Advantageously, the ammonium hydroxide content is greater than about 20% by weight based on the total weight of the mixture. When diammonium phosphate is used, its content in the aqueous mixture may be from about 0.5% to about 30%, typically from about 1% to about 10% by weight based on the total weight of the mixture. The molar ratio of fructose to ammonium hydroxide in the mixture is preferably from about 0.1:1 to about 5:1, and typically is about 0.5:1 to about 2:1. When diammonium phosphate is included in the mixture, the molar ratio of ammonium hydroxide to diammonium phosphate is from about 5:1 to about 0.01:1, typically from about 0.5:1 to about 0.1:1. It is preferable that more ammonium hydroxide is used than diammonium phosphate.

Typically the reaction mixture is an aqueous mixture. A fructose source, ammonium hydroxide, and optionally diammonium phosphate are mixed together with a liquid medium having an aqueous character such as a liquid consisting primarily of water, normally greater than about 90 weight percent water, and can be essentially pure water. For example, the liquid medium can be distilled water, tap water, or the like. pH optimization is optionally performed. Typically, the pH of the mixture can be from about 5 to about 11. Preferably, the aqueous content of the reaction mixture is less than about 35%, preferably less than about 25% by weight. Thus the reactants are preferably present in an amount of at least about 65% by weight.

The aqueous mixture is reacted, for a time under conditions sufficient to generate a heat activatable flavorant-generating composition. The aqueous mixture can be reacted at a temperature of from about 4° C. to about 85° C., preferably from about 10° C. to about 70° C., more preferably from about 20° C. to about 45° C. Preferably, the mixture is reacted conveniently at room temperature at about 20° C. to about 25° C. Because the flavorant-generating composition is heat activatable, i.e., can be decomposed and converted into volatile flavorants, it is undesirable to subject the aqueous mixture to a temperature of 90° C. or greater. Under a heat treatment at high temperatures, e.g., greater than 90° C., the yield of the flavorant-generating materials will be significantly lower.

If the mixture is subjected to a moderate heat treatment within the above ranges, it is preferred to admix the fructose source and/or diammonium phosphate with an aqueous medium and heat them to the desired heating temperature before ammonium hydroxide is added. As will be apparent to a skilled artisan, this is because ammonium hydroxide is prone to decomposition under heat to release ammonia in a gas form, which can escape from the aqueous mixture. Therefore, the delayed addition ammonium hydroxide helps to increase the yield of 2-deoxy 2-amino sugars.

The mixture can be reacted under an ambient pressure environment, i.e., in a vented reactor. Alternatively, the reaction can be in a closed environment, and optionally under pressure. An enclosed or pressure-controlled environment can be useful when the reaction mixture is subjected to a heat treatment, since ammonia gas generated from the decomposition of ammonium hydroxide can be more readily retained in the aqueous mixture for reaction with the fructose. Examples of suitable vessels include reactors sold by American Reactor Corporation having a sealable vent and a heating jacket. The pressure can range from atmospheric up to about 500 psig. The heat treatment of the mixture under pressure can be performed under an inert atmosphere. For example, nitrogen and argon gas can be employed in order to provide an inert atmosphere. However, the heat treatment can be conducted under ambient air.

The amount of reaction time required can vary with the temperature. Typically, less time is necessary if the aqueous mixture is under a moderate heat treatment. Conversely, more time is required when the reacting temperature is low. For example, the aqueous mixture can be placed at room temperature (about 20° C. to 25° C.) for about 12 to about 36 hours or longer. When the reaction is conducted at about 80° C., about 5 to 10 minutes or even less may be sufficient. Some minor experiments may be required to determine the optional reacting time at a particular temperature, this being well within the capability of one skilled in the art once apprised of the present disclosure.

The reaction in the mixture in the present invention leads to the formation of heat activatable flavorant-generating composition including amino sugars, particularly 2-deoxy 2-amino glucose. Other amino sugars such as mannosamine, galatosamine, or the 1-deoxy 1-amino sugars disclosed in U.S. Pat. No. 4,638,816 can also be generated, especially when the fructose source used is a crude form of fructose and contains other reducing sugars. Such other amino sugars can also release flavorful and aromatic substances under heat treatment. However, as discussed above, it has been discovered that fructose is highly reactive with ammonium. In particular, fructose can be three times more reactive to ammonia than, e.g., glucose in forming glucosamine. In accordance with the present invention, the heat activatable flavorant-generating composition typically contains 2-deoxy 2-amino sugars such as glucosamine, galactosamine and mannosamine, with an amine group at the $C_2$ position of the amino sugars. Typically, the heat activatable flavorant-generating composition produced in the invention, i.e., the liquid mixture resulting from the heat treatment, contains at least about 0.1% by weight, preferably at least 0.5% by weight, and more preferably at least about 1% by weight of 2-deoxy 2-amino sugars. Heat activatable flavorant-generating compositions containing up to 10% to 15% by weight of 2-deoxy 2-amino sugars can be obtained according to the present invention. Typically, 2-deoxy 2-amino glucose constitutes at least about 50%, preferably at least about 60% of the total amount of 2-deoxy 2-amino sugars in the composition. 2-amino-deoxy glucose has the formula:

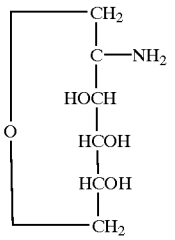

2-deoxy 2-amino glucose
(glucosamine)

Typically a liquid composition is formed after the reaction and the amount of solid materials therein is minimal. If more solid materials are formed at higher temperatures, the mixture may optionally be filtered, e.g., through a 60-mesh screen filter to remove large solid aggregates. Preferably the liquid composition is refrigerated during storage until use to prevent the heat activation of the flavorant-generating composition. Typically it should be kept below room temperature, preferably kept refrigerated at about 4° C. or less. The amino sugars can be isolated from the composition and applied to smoking articles. However, the composition can be conveniently applied directly to various components of smoking articles. Once applied to tobacco or a tobacco containing smokable materials in a smoking article, the heat activatable flavorant-generating composition including 2-deoxy 2-amino sugars such as 2-deoxy 2-amino glucose is generally stable.

Accordingly, the present invention provides smoking articles containing the heat activatable flavorant-generating composition as described above, and in particular, smoking articles incorporating externally produced 2-deoxy 2-amino sugars such as 2-deoxy 2-amino glucose. Smokable materials such as tobacco cut filler typically contains a small amount of certain amino sugars resulting from the reaction between the endogenous nitrogen source and endogenous or external sugars. Thus, the term "externally produced" is used herein to refer to the 2-deoxy 2-amino sugars or heat activatable flavorant-generating composition that is not produced on or in the tobacco during processing thereof.

When smoking articles containing the heat activatable flavorant-generating composition are used, i.e., smoked, the heat from, e.g., combustion of the tobacco rod, causes heat activation of the flavorant-generating materials, particularly 2-deoxy 2-amino sugars incorporated in the smoking article, to yield compositions or products which exhibit an aroma which can be characterized as pleasant, clean, and sweet. The aroma provided is such that the characteristic sidestream cigarette smoke aroma is masked or overridden by those components. As such the heat activatable flavorant-generating composition also provides for a reduction in the negative attributes associated with the aroma of sidestream smoke.

The burning system of the cigarette has been well established in the art. During puffing, air is drawn into the cigarette through or around the coal on the end of the cigarette and mainstream smoke is formed. The oxygen in the inspired air causes incomplete combustion of the coal yielding tarry vapor, water, and gases at about 900° C. peak temperature. In the interval between puffs, smoldering occurs and air is drawn upward around the coal which forms sidestream smoke. The mainstream smoke cools down as it travels along cigarette rod. Further, during puffing, the heat of the coal and the smoke cause pyrolysis of the tobacco immediately behind the combustion zone. As a result of these processes, different locations within the cigarette rod can have different temperatures that can range up to about 20° C. to as high as 900 to 1000° C. Although not wishing to be bound to any theory, it is believed that during the smoking process, the heat activatable flavorant-generating composition in the smoking article is heated and undergoes a series of chemical reactions to form flavorful pyrazines often found in tobacco-derived flavorful and aromatic compounds.

The heat activatable flavorant-generating composition can provide the above flavorful and aromatic compounds when heated to a temperature of from about 70° C. to about 1000° C., preferably to about 200° C. or higher, and most preferably to a temperature of about 250° C. or higher. Therefore, the heat activatable flavorant-generating composition can be incorporated to any part of the smoking article that is heated during the smoking process to a temperature within the above ranges. In a smoking article such as a cigarette, because the combustion zone moves toward the smoker during the entire smoking process, the above temperatures may be reached at almost any location in the cigarette rod. Therefore, the heat activatable flavorant-generating composition can be located anywhere within the cigarette rod, wrapping paper, etc.

As discussed above, the heat activatable composition is not stable under heat and is preferably kept refrigerated until use. Unlike the method disclosed in U.S. Pat. No. 5,648,816, a preheating treatment, although may be useful, is not required either before or after it is applied to smoking articles. Preferably, the flavorant-generating composition of the invention is applied to smoking articles under conditions such that at least about 25%, preferably at least 50%, and more preferably at least about 70% of the 2-deoxy 2-amino sugars applied during the smoking article manufacturing process is retained and incorporated into the final smoking article produced. The final smoking article typically contains at least about 0.1% by weight of total 2-deoxy 2-amino sugars based on the total smokable component content. Preferably, the smoking article contains at least about 0.2%, more preferably at least about 0.5%, and most preferably at least about 1.0% by weight of 2-deoxy 2-amino sugars based on the total smokable component content.

Thus, typically heat treatment of the heat activatable flavorant-generating composition alone or heat treatment of the smoking article components impregnated with the composition is to be avoided during smoking article manufacturing, i.e., prior to incorporation of the composition into a smoking article. If for any reason the composition has to be subjected to a heat treatment, the temperature of the heat treatment is preferably below about 85° C., more preferably below about 70° C., and the heating time should be minimized to, e.g., less than one hour, preferably less 30 minutes.

The heat activatable flavorant-generating composition can be incorporated into smoking articles by various methods. Pure amino sugars can be isolated from the heat activatable flavorant-generating composition before use and applied to smokable materials. Preferably, the composition is applied directly as an aqueous composition with or without other flavorants. For example, the heat activatable flavorant-generating composition can be incorporated into smokable materials as a top dressing ingredient. As is well known in the art, top dressing is added after the tobacco blend is cut into shreds or "cut filler", to supply aroma or pleasing flavor. Top dressing is usually applied as a spray solution containing highly aromatic, perfume-like substances and a material such as a glycol to retard the evaporation of the flavorant in the cigarette or cigarette package. The heat activatable flavorant-generating composition can be mixed into the top dressing spray solution which is then sprayed onto the tobacco fillers. The liquid heat activatable flavorant-generating composition can also be applied to the tobacco cut filler in the same manner. Isolated 2-deoxy 2-amino sugars can also be applied directly onto tobacco cut filler in the form of powder or solution. The composition can also be incorporated into smoking articles concurrently as the tobacco cut filler is formed into cigarette rods.

In a like manner, the heat activatable flavorant-generating composition can also be applied onto cigarette wrapping paper, preferably on the inside surface, during the cigarette manufacturing process.

Similarly, the heat activatable flavorant-generating composition can be incorporated into, or applied onto reconstituted tobacco materials including cast reconstituted tobacco materials, reconstituted tobacco materials formed by paper making processes or the like.

Smoking articles can further include a filter element positioned adjacent to one end of rod such that the filter element is axially aligned with the rod in an end-to-end relation. Filter elements have a substantially cylindrical shape, and the diameter of the rod is substantially equal to the diameter of the filter element. Preferably, the filter element abuts the rod. The ends of the filter element are open to permit the passage of air and smoke therethrough. The filter element comprises filter material which optionally is overwrapped with circumscribing wrap material.

The heat activatable flavorant-generating composition can be incorporated into the cigarette filter, either in the filter plug or plug wrap, or tipping paper. For example, the heat activatable flavorant-generating composition can be incorporated into low-density polyethylene which is formed into strands, and then incorporated into cigarette filters as described in U.S. Pat. Nos. 4,281,671 to Bynre et al. and U.S. Pat. No. 4,826,905 to Green, Jr. et al. The heat activatable flavorant-generating composition can also be incorporated into the filter material by soaking the filter material in the heat activatable flavorant-generating composition, or by spraying the composition onto the filter material or by spreading isolated 2-deoxy 2-amino sugars during the process of making the filter. The filter material can be a conventional cigarette filter material such as cellulose acetate, polypropylene, or the like, and the filter element can have a fibrous character, a molded shape, or other such configuration. As the heat activatable flavorant-generating composition must be heated at a sufficiently high temperature, it is preferably incorporated in the bottom portion of the filter which abuts the cigarette rod.

The heat activatable flavorant-generating composition can also be used in a similar manner in many types of smoking articles other than the currently widely available cigarette constructions. For example, tobacco cut filler having the heat activatable flavorant-generating composition applied therein may be combined with aerosol forming materials, and employed in the manufacture of those smoking articles described in U.S. Pat. Nos. 4,708,151 to Shelar; U.S. Pat. No. 4,771,795 to White et al.; U.S. Pat. No. 4,714,082 to Banerjee et al.; U.S. Pat. No. 4,756,318 to Clearman et al.; and U.S. Pat. No. 4,793,365 to Sensabaugh et al., as well as European Patent Publication Nos. 212,234 and 277,519, the disclosures of which are incorporated herein by reference. In addition, the tobacco cut filler containing the heat activatable flavorant-generating composition can be incorporated into those smoking articles described in U.S. Pat. No. 5,074,321 and European Patent Publication No. 280,990.

The amount of the heat activatable flavorant-generating composition employed in smoking articles can vary. For example, in a typical cigarette having about 0.6 to about 1 g/rod of smoking material a sufficient quantity of the composition can be applied to provide a total 2-deoxy 2-amino sugar content of about 1000 ppm to about $10^4$ ppm based on the total weight of smokable materials in the cigarette. Generally a liquid flavorant-generating composition of this invention can be applied in cigarettes at an amount of up to 10% of the total dry weight of tobacco materials. In the case of isolated 2-deoxy 2-amino sugars, the amount of application can be calculated based on the isolation yield. When a large amount of the heat activatable flavorant-generating composition needs be added, the tobacco cut filler can be dried to some extent to reduce the moisture content therein before the liquid heat activatable flavorant-generating composition is applied. In this way, heating the impregnated cut filler to reduce moisture before packaging into cigarette rods can be avoided.

Typically, the smoking article, e.g. a cigarette of this invention contains from about 100 ppm to about 15,000 ppm, preferably from about 1,000 ppm to about 5,000 ppm of exogenous, i.e., externally produced 2-deoxy 2-amino glucose derived from the heat activatable flavorant-generating composition prepared in this invention.

Because the heat activatable flavorant-generating composition can generate highly desirable flavor and aroma, in advantageous embodiments of the invention, sugars added via conventional casing or like treatments can be reduced or eliminated. Advantageously, the total exogenous or added sugar content of the smoking article is less than the heat activatable flavorant-generating composition content thereof. In preferred aspects of this embodiment, the smoking article is substantially free of exogenous, i.e., added sugar.

The following example is provided in order to further illustrate preferred aspects of the invention but should not be construed as limiting the scope thereof. Unless otherwise noted, all parts and percentages are by weight.

EXAMPLE I

HFCS (Corn Products International, Bedford Park, Ill., with 42% by weight of fructose) and water, and optionally diammonium phosphate (DAP) are pre-mixed in a Breddo high-shear mixture at room temperature for 5 minutes yielding a mixture of solids and water. The mixture is pumped into a vented and jacketed American Reactor Corporation (Designed by Autoclave Engineers) 50-gallon reactor, and heated to 180° F. using steam in the jacket. The reactor vent is then closed. A $NH_4OH$ solution is added over a 5-minute period at a rate of 7 pounds per minute. After the addition, the mixture is cooled, or held at 180° F. for 5 minutes and cooled, to 100° F. using cold water in the jacket over approximately 20 minutes. The contents are then discharged through a 60-mesh screen filter into appropriate containers. The final mixture is a reddish-black low-viscosity liquid with a high solids content. The final mixture is maintained at a temperature of 40° F. or below until use. The final mixture is analyzed by HPLC for amino sugar contents. The result is shown in Table 1.

TABLE 1

| | Components | Amount (% w/w) | Mannosamine (2-Deoxy-2-Amino Mannose) (ppm) | Galactosamine (2-Deoxy-2-Amino Galactose) (ppm) | Gluosamine (2-Deoxy-2-Amino Gluocse) (ppm) | Heat Total (ppm) | Heat Temp (° F.) | Time (mins) |
|---|---|---|---|---|---|---|---|---|
| #1 | HFCS | 33.39 | 395 | 82 | 2,257 | 2,734 | 180 | 0 |
| | 29.4% $NH_4OH$ | 9.05 | | | | | | |
| | 30% DAP | 10.12 | | | | | | |
| | Water | 47.44 | | | | | | |

TABLE 1-continued

| | Components | Amount (% w/w) | Mannosamine (2-Deoxy-2-Amino Mannose) (ppm) | Galactosamine (2-Deoxy-2-Amino Galactose) (ppm) | Gluosamine (2-Deoxy-2-Amino Gluocse) (ppm) | Heat Total (ppm) | Heat Temp (° F.) | Time (mins) |
|---|---|---|---|---|---|---|---|---|
| #2 | HFCS | 33.33 | 857 | 97 | 2,633 | 3,587 | 180 | 0 |
| | 29.4% $NH_4OH$ | 2.65 | | | | | | |
| | 30% DAP | 34 | | | | | | |
| | Water | 23.6 | | | | | | |
| #3 | HFCS | 33.2 | 1,261 | 94 | 3,080 | 4,434 | 180 | 0 |
| | 29.4% $NH_4OH$ | 4.65 | | | | | | |
| | 30% DAP | 17.1 | | | | | | |
| | Water | 44.94 | | | | | | |
| #4 | HFCS | 33.3 | 919 | 204 | 2,309 | 3,431 | 180 | 0 |
| | 29.4% $NH_4OH$ | 2.3 | | | | | | |
| | 30% DAP | 25.6 | | | | | | |
| | Water | 38.7 | | | | | | |
| #5 | HFCS | 33.3 | 1,436 | 61 | 5,219 | 7,867 | 180 | 0 |
| | 29.4% $NH_4OH$ | 6.9 | | | | | | |
| | 30% DAP | 8.6 | | | | | | |
| | Water | 51.2 | | | | | | |
| #6* | HFCS | 78.8 | 6,774 | 1,327 | 13,118 | 21,219 | 180 | 5 |
| | 29.4% $NH_4OH$ | 8.6 | | | | | | |
| | 30% DAP | 0 | | | | | | |
| | Water | 12.6 | | | | | | |
| #7* | HFCS | 57.7 | 4,359 | 206 | 10,046 | 14,611 | 180 | 5 |
| | 29.4% $NH_4OH$ | 4.2 | | | | | | |
| | 30% DAP | 3.1 | | | | | | |
| | Water | 35 | | | | | | |
| #8 | HFCS | 71.1 | 8,191 | 1,483 | 10,569 | 20,244 | 180 | 5 |
| | 29.4% $NH_4OH$ | 5.1 | | | | | | |
| | 30% DAP | 3.8 | | | | | | |
| | Water | 20 | | | | | | |
| #9 | HFCS | 74.3 | 42,170 | 2,033 | 60,424 | 104,628 | 25 | 1200 |
| | 29.4% $NH_4OH$ | 25.7 | | | | | | |

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A method for improving the flavor and aroma properties in a smoking article comprising:

providing an aqueous mixture consisting essentially of a fructose source and ammonium hydroxide;

reacting the mixture for a time and under conditions sufficient to provide a heat activatable flavorant-generating composition comprising at least one 2-deoxy 2-amino sugar, wherein the mixture is reacted at a temperature no greater than about 85° C.; and applying an amount of said composition to at least one component of a smoking article.

2. The method of claim 1, wherein said mixture further contains diammonium phosphate.

3. The method of claim 1, wherein said reacting step is conducted at a temperature of from about 4° C. to about 85° C.

4. The method of claim 1, wherein said reacting step is conducted at about 25° C.

5. The method of claim 4, wherein the reacting step is conducted for a period of from about 12 hours to about 36 hours.

6. The method of claim 1, wherein said heat activatable flavorant-generating composition comprises at least about 0.5% by weight of 2-deoxy 2-amino sugars based on the total weight of the composition.

7. The method of claim 1, wherein said aqueous mixture comprises from about 20% to about 50% by weight of fructose and from about 1% to about 30% by weight of ammonium hydroxide based on the total weight of the mixture.

8. The method of claim 1, wherein said fructose source is a high fructose corn syrup.

9. The method of claim 1, wherein said heat activatable flavorant-generating composition is applied as a top dressing or a component thereof.

10. The method of claim 1, wherein said smoking article is a cigarette having a wrapping paper, and said heat activatable flavorant-generating composition is applied to the wrapping paper of the cigarette.

11. The method of claim 1, wherein said smoking article is a cigarette having a filter element, and said heat activatable flavorant-generating composition is incorporated in the filter element.

12. The method of claim 1, wherein the smoking article having said heat activatable flavorant-generating composition incorporated therein contains at least about 0.2% by weight of 2-deoxy 2-amino sugars based on the total weight of the smokable materials of the smoking article.

13. A smoking article prepared by the method of claim 1.

14. The method of claim 1, wherein said reacting step is conducted at a temperature of no greater than 50° C.

15. The method of claim 1, wherein said reacting step is conducted at a temperature of from about 10° C. to about 70° C.

16. The method of claim 1, wherein said reacting step is conducted at a temperature of from about 20° C. to about 25° C.

17. A method for improving the flavor and aroma properties in a smoking article containing smokable materials, comprises:

providing an aqueous mixture consisting essentially of from about 20% to about 50% by weight of fructose, and from about 1% to about 30% by weight of ammonium hydroxide based on the total weight of the aqueous mixture;

reacting the mixture for at least about 12 hours at a temperature of about 25° C. to provide a heat activatable flavorant-generating composition; and applying said composition as a top dressing or component thereof to at least one component of a smoking article in an amount sufficient such that the final smoking article comprises at least about 0.2% by weight of 2-deoxy 2-amino sugars based on the total weight of the smokable materials incorporated into said smoking article.

18. A smoking article prepared by the method of claim 13.

* * * * *

UNITED STATES PATENT AND TRADEMARK OFFICE

CERTIFICATE OF CORRECTION

PATENT NO. : 6,440,223 B1
DATED : August 27, 2002
INVENTOR(S) : Dube et al.

It is certified that error appears in the above-identified patent and that said Letters Patent is hereby corrected as shown below:

Columns 9-10, Table 1,
In the sub-heading of the seventh column,
Line 1, cancel “Heat”.

Columns 11-12, Table 1-continued,
In the sub-heading of the seventh column,
Line 1, cancel “Heat”.

Column 13,
Line 9, “comprises” should read -- comprising --.

Column 14,
Line 11, “claim 13” should read -- claim 17 --.

Signed and Sealed this

Twenty-eighth Day of January, 2003

JAMES E. ROGAN
*Director of the United States Patent and Trademark Office*